US005315966A

United States Patent [19]

Gamache et al.

[11] Patent Number: 5,315,966

[45] Date of Patent: May 31, 1994

[54] HAMMERING DEVICE FOR TUBE BOILERS

[76] Inventors: Serge Gamache, 510 Bellevue, St-Lambert, Canada, G0S-2W0; Louis-Paul Gauvin, 4832 Du Morillon, St-Augustin, Quebec, Canada, G3A 1Z6

[21] Appl. No.: 5,339

[22] Filed: Jan. 19, 1993

[51] Int. Cl.[5] ..... F28G 7/00

[52] U.S. Cl. ..... 122/379; 15/104.07; 165/84; 165/95

[58] Field of Search ..... 122/379; 165/84, 95; 15/104.07

[56] References Cited

U.S. PATENT DOCUMENTS

| | | | |
|---|---|---|---|
| 1,125,950 | 1/1915 | Bragstad | 15/104.07 |
| 1,275,009 | 8/1918 | Eriksson | 15/104.07 |
| 3,835,817 | 9/1974 | Tuomaala | 122/379 |
| 4,741,292 | 5/1988 | Novak | 122/379 |

FOREIGN PATENT DOCUMENTS

| | | | |
|---|---|---|---|
| 3942759 | 6/1991 | Fed. Rep. of Germany | 165/95 |
| 2404191 | 5/1979 | France | 165/95 |
| 1295197 | 3/1987 | U.S.S.R. | 165/95 |
| 1348625 | 10/1987 | U.S.S.R. | 165/95 |

*Primary Examiner*—Henry A. Bennet
*Assistant Examiner*—William C. Doerrler

[57] ABSTRACT

To clean boiler tubes, a hammering device for shaker rods comprises a series of hammers mounted on a horizontal shaft for vertical rotation. The hammers are moved clockwise around the shaft somewhat less than 180° from the face of the rod, and then released circumferentially around the shaft axis to fall by gravity in anticlockwise direction, thereby hitting the surface of the shaker rod in a straight line. The hammer comprises a hitting surface and a support shank on which a piece of lug is installed parallel to the hitting surface. To move the hammer, a cam fixed to the shaft engages eccentrically the lug so the cam releases the lug at 100° to 130°, that is somewhat less than a half turn. The lug is provided with an outer rotating ring. The hammer impact surface defines a cam such that an apex point faces the impact transfer axis of the shaker rod in a series of positions of hammer varying between −2° and +8°.

5 Claims, 8 Drawing Sheets

HAMMERING DEVICE FOR TUBE BOILERS

FIELD OF INVENTION

This invention concerns a cleaning device for exchanger tubes disposed in a passing channel of hot gases such as in a recuperating type boiler, an economizer, an overheat, etc. It is known some heat exchangers have their heating surfaces constituted by tubes disposed as a coil, hanged in parallel rows in square passages of hot gases.

As those gases are more or less charged with dust, different matters are disposed on the outside of the coiled tubes. To maintain efficient heat exchange, it is useful to clean those tubes periodically.

PRIOR ART

Among the techniques imagined to clean arrays of tubes it is common practice to hit those tubes with a hammer. Hammering causes impact vibrations as a result of which dust and other particles fall.

Patent 58/95199 Japan Ueda, June 1983, discloses a rotatable hammer linked to a rotary shaft turning clockwise: the hammering speed is adjusted by changing the speed of rotation of the shaft.

U.S. Pat. No. 4,892,139 LaHaye, January 1990, uses electrostatic charges to effect the cleaning of tubes.

U.S. Pat. No. 4,825,940 Barroyer, May 1989, illustrates resilient members located within the tubes and made to vibrate upon the injection of compressed gases.

U.S. Pat. No. 4,741,292 Novak, May 1988, utilizes an electromagnetic type actuator creating an impulse on a selected rod.

Many methods have been conceived to hit coiled tubes. Among these methods, many use an impact device on a hammering rod transmitting impact to heat exchanger tubes.

To produce this impact, some have used, with more or less success, pneumatic hammers, electro-magnetic or rotula hammers mounted on a motorized shaft. Use of rotula hammer, frequently, suffers from many defects related to the relative position of the elements. The most important defect is that this kind of hammer doesn't hit hammering rods along the longitudinal axis. Moreover, this kind of hammer twists the rods so one has to change the rods often. On the other hand, impact occurs at a the wrong time in the cycle, wearing off rolling and rotula rods. More over, assembly of those hammers complicates maintenance.

Finally, using rotula hammers doesn't allow fine adjustment of impact force on hammering rods. With that system, the only method of adjustment is by varying weight of hammers. Weight adjustment is difficult to effect.

Purpose

A purpose of this invention is to provide a hammering device for rods subject to transmit vibration energy and impact, and comprising a horizontal shaft, a series of hammers mounted on a shaft for vertical rotation and means to move each hammer around shaft axis less than half-turn from the face of the rod, those means releasing hammer to fall anticlockwise by gravity. Hammer moving means may be a cam acting on a lug on the hammer shank, a cam fixed to the shaft and engaging eccentrically the lug so the cam releases lug at a certain point on the half-turn. Lug can be rotating. Hammering device for rods can turn 180° but stops preferably at 100° to 130° on the half-turn.

The impact surface of the hammer defines a cam such that an apex point is in front of the hammering axis in a set of hammer positions varying between −2° and +8°.

The proposed system avoids many problems encountered with other systems. The most important feature is that the hammer impact is always produced along the rod axis. Because of the calculated shape of the hammer, the impact of the hammer onto the rod is flat and falls into the center of the axis of the rod.

This feature allows a near perfect transfer of kinetic energy into mechanical energy and avoids the blistering of the face of the rod. The new system allows the easy adjustment of the face of impact of the hammer on the rods by simply adjusting the angle of eccentricity of the system. The hammer must be in a position to freely pivot around an eccentric sleeve in a plane perpendicular to that eccentric sleeve.

The hammer is carried upwards by a cam fixed to a motorized shaft. The cam pushes on a lug fixed to the hammer shank. The hammer pivots and raises while describing a circular path as the cam pushes onto the lug. It is the eccentricity of the sleeve-shaft system which allows the hammer to disengage from the lug of the cam. Once disengaged the hammer falls thanks to the gravitational force and hits the hammering rod.

The invention can be better understood by referring to the drawings wherein.

Figure 1:
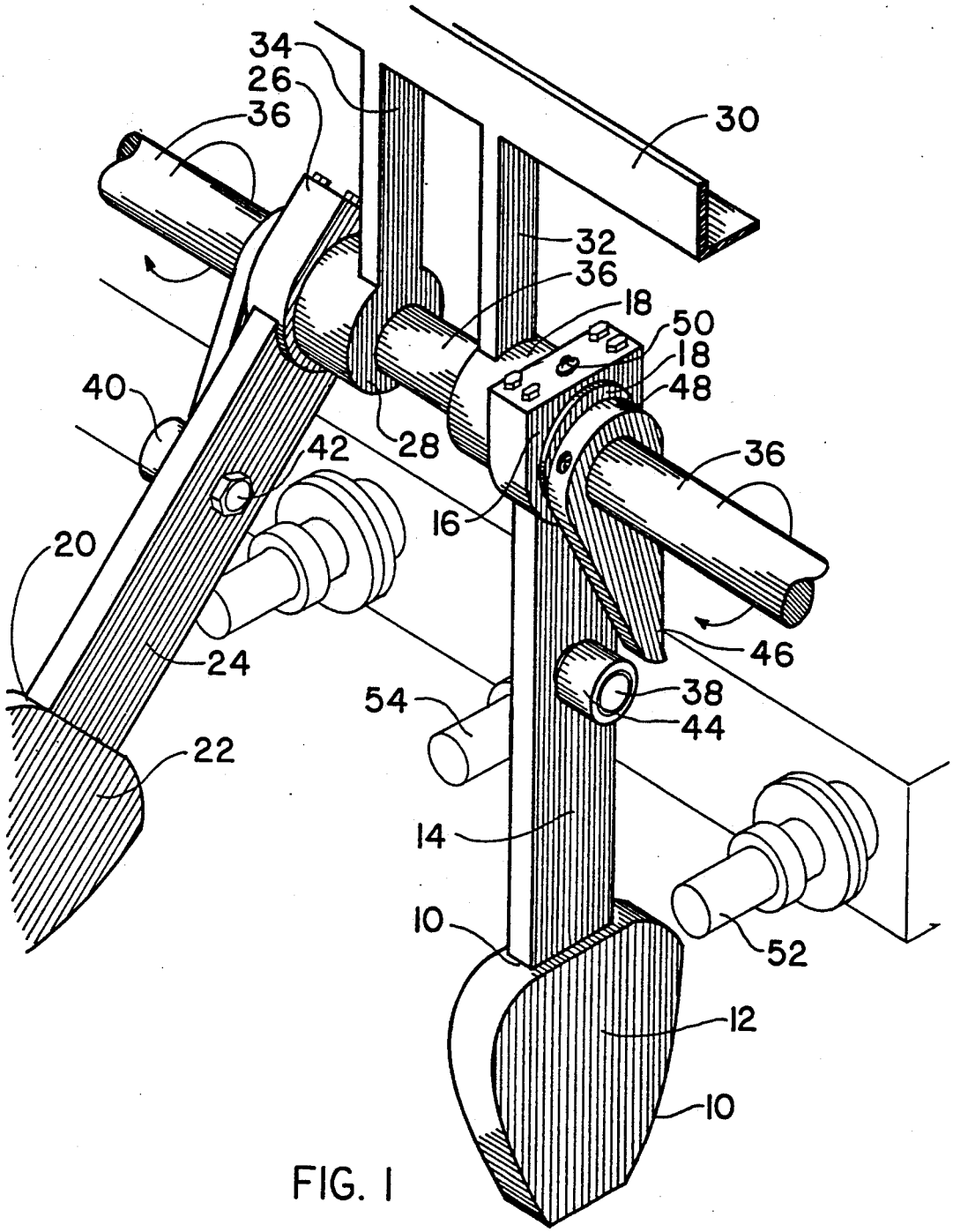
FIG. 1 is a perspective view of two hammers hanging and in motion.
Figure 2:
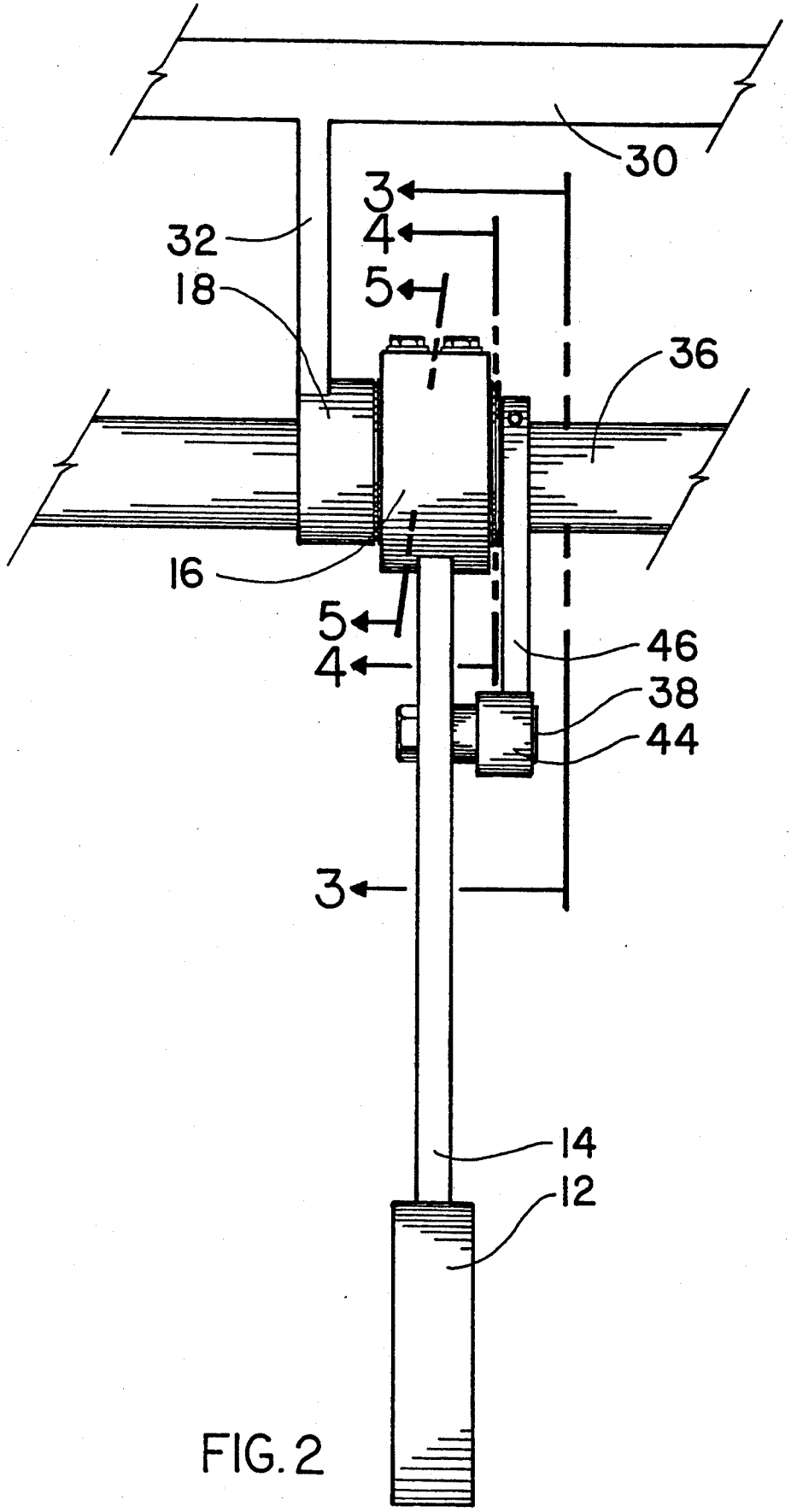
FIG. 2 is a view from the back of the hammer system.

Relative to the drawings one sees at the right of FIG. 1 a hammer 10 provided with a hitting head 12 and a support shank 14 attached to a collar 16 installed freely moveable on an eccentric sleeve 18. At the left of FIG. 1 is a second hammer 20 provided with a hitting lead 22 a shank 24 fixed to a collar 26 freely mounted onto an eccentric 28. The eccentrics 18 and 28 are attached to a supporting structure 30 by means of rigid elements 32 and 34 and are united by a shaft 36 which crosses both eccentrics. A lug 38 is installed onto support 14 as well as another identical lug 40 onto support 24 by means of a screw 42. The lug 38 possesses a rotating envelope 44. The shaft 36 normally turns without stop in a clockwise direction. An elongated cam 46 is fixed to shaft 36 by screws 48 and covers more than the distance between shaft 36 and lug 38 of hammer 10 in such manner that the shaft turning clockwise the elongated cam engages at least the external envelope 44 of lug 38 so as to displace it in clockwise fashion. Collar 16 is mounted sliding and rotating and helped by a cup of lubricant 50 onto eccentric 18. Hammer 10 is positioned in same plane as hammering rod 52 like hammer 20 facing hammer rod 54.

Figure 3:
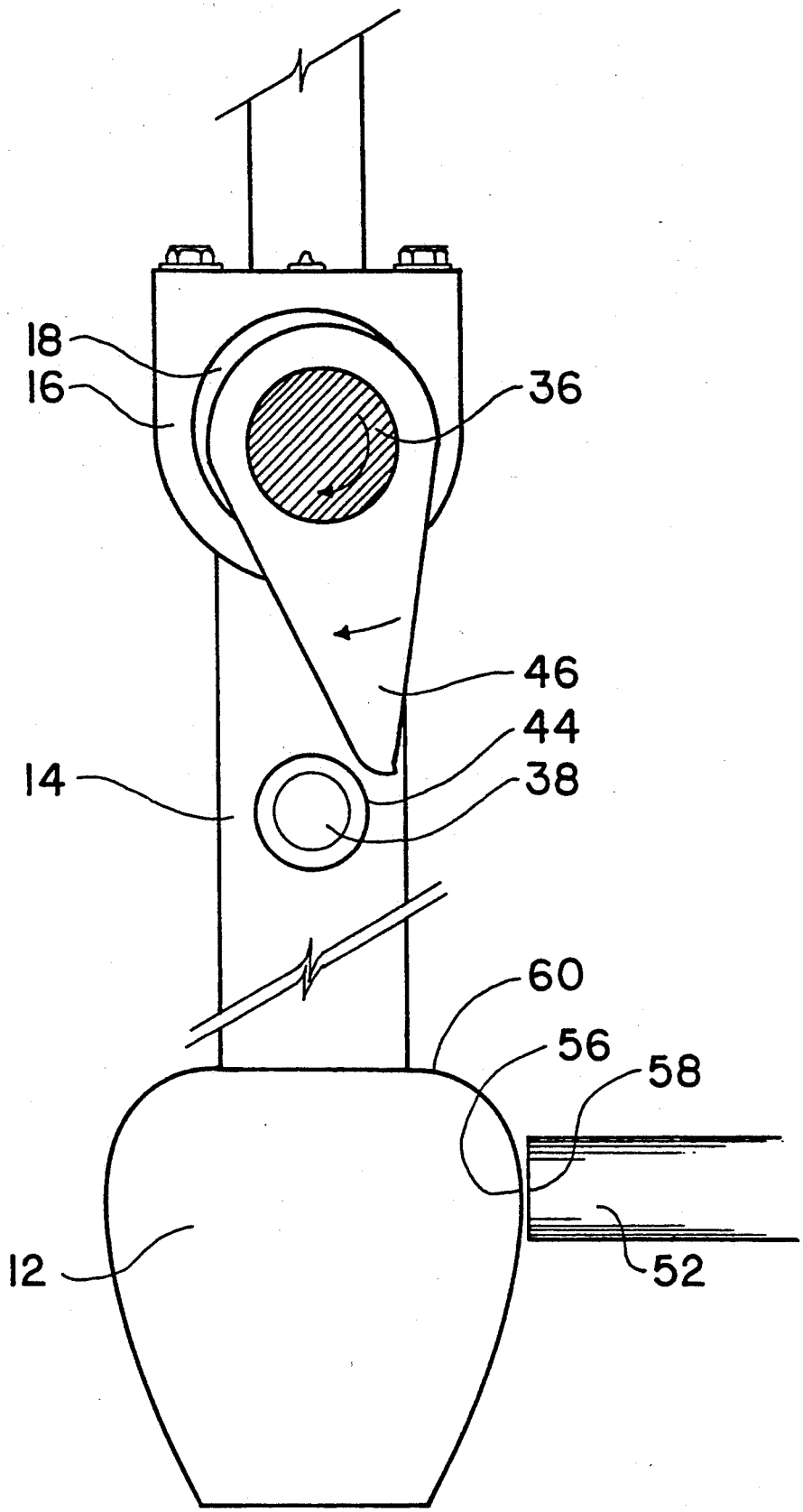
FIG. 3 is a side view of the hammer of FIG. 2 according to line 3—3 of FIG. 2.
Figure 5:
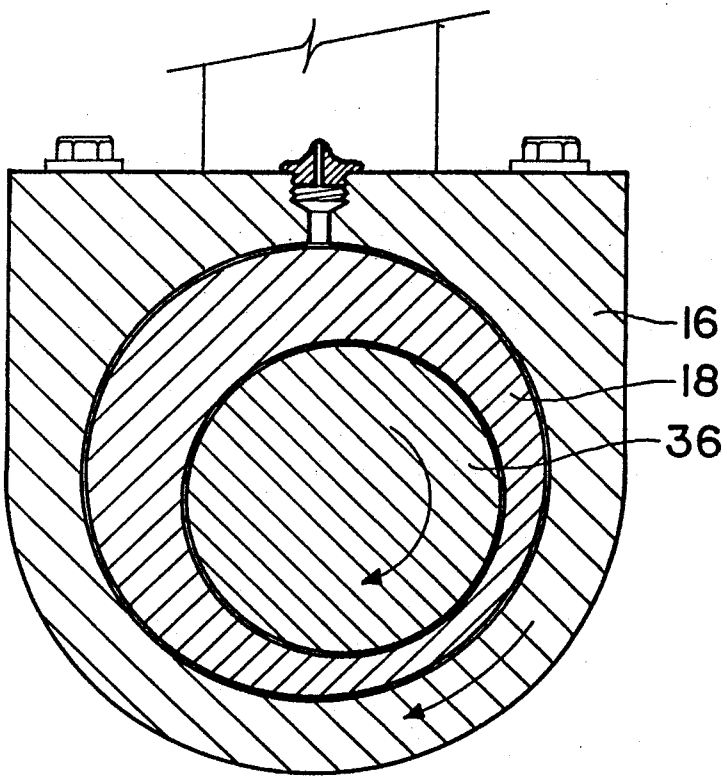
FIG. 5 is a cut view according to line 5—5 of FIG. 2.
Figure 4:
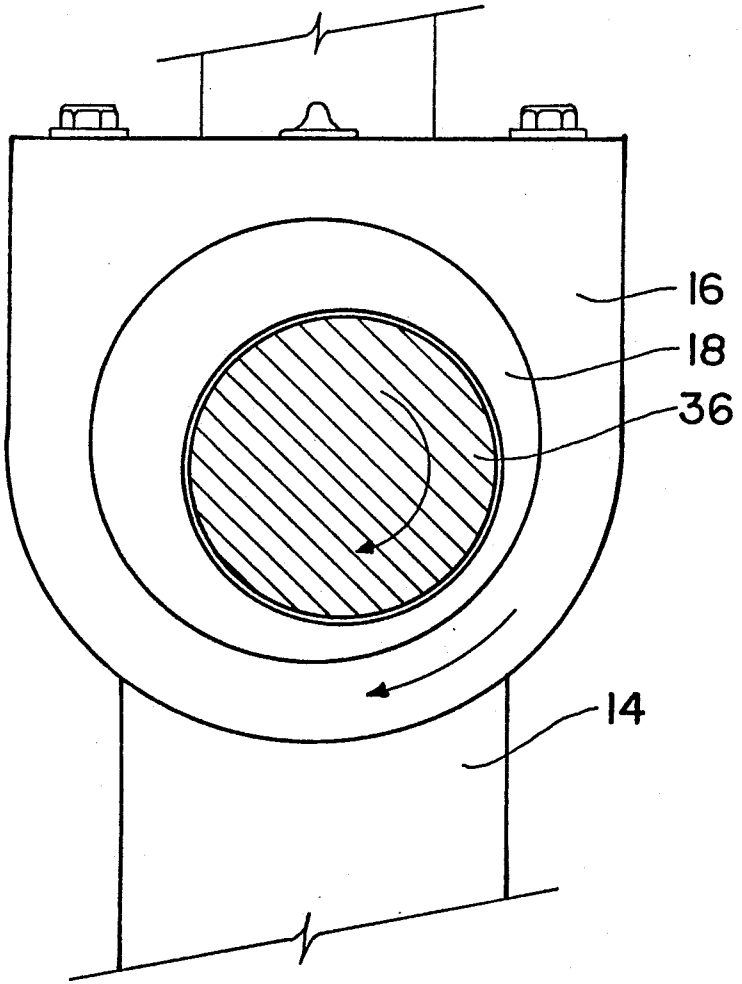
FIG. 4 is a view of a partial cut according to line 4—4 of FIG. 2.
Figure 6:
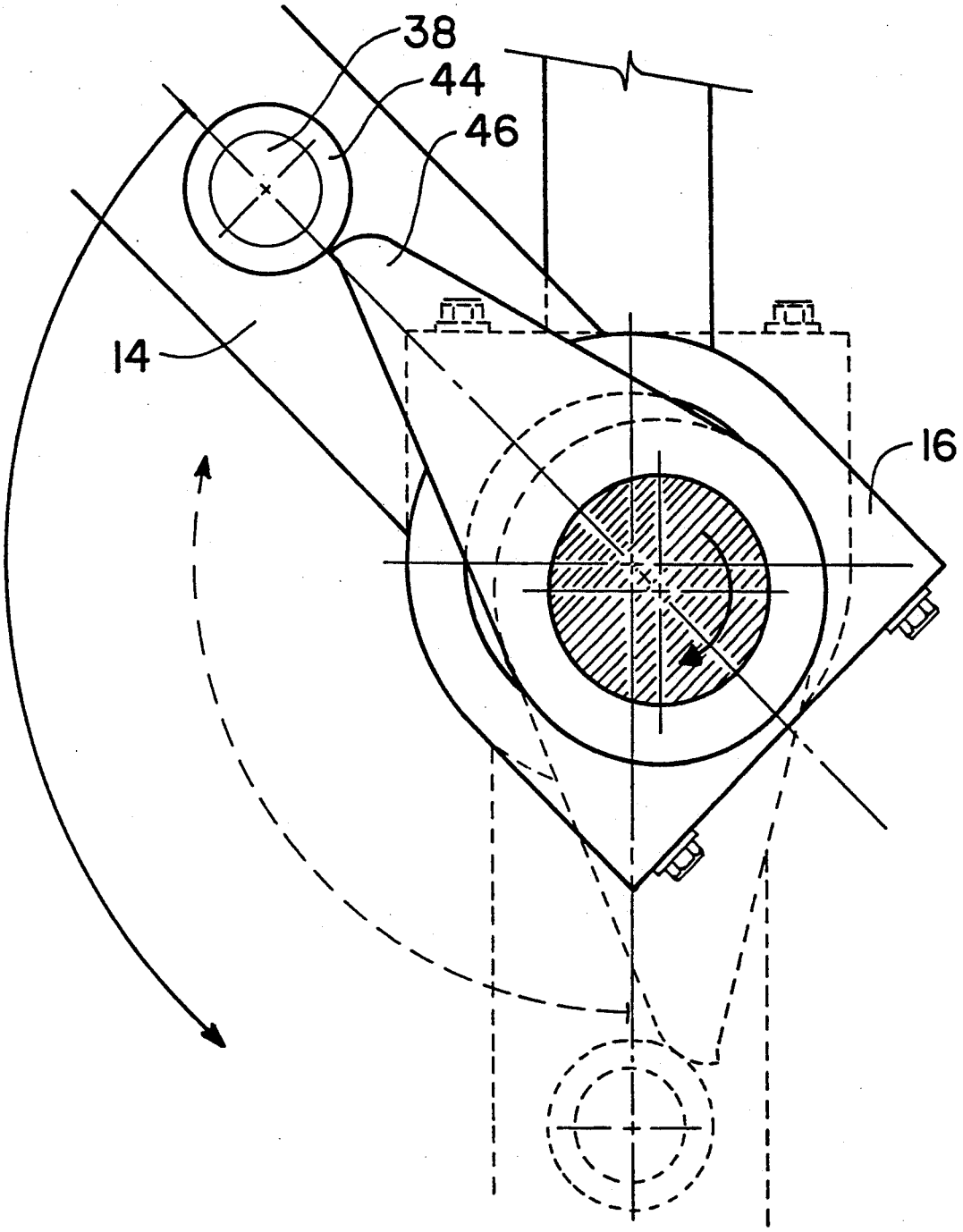
FIG. 6 is a face view like FIG. 3 illustrating two positions of which one is represented by dotted lines.
Figure 7:
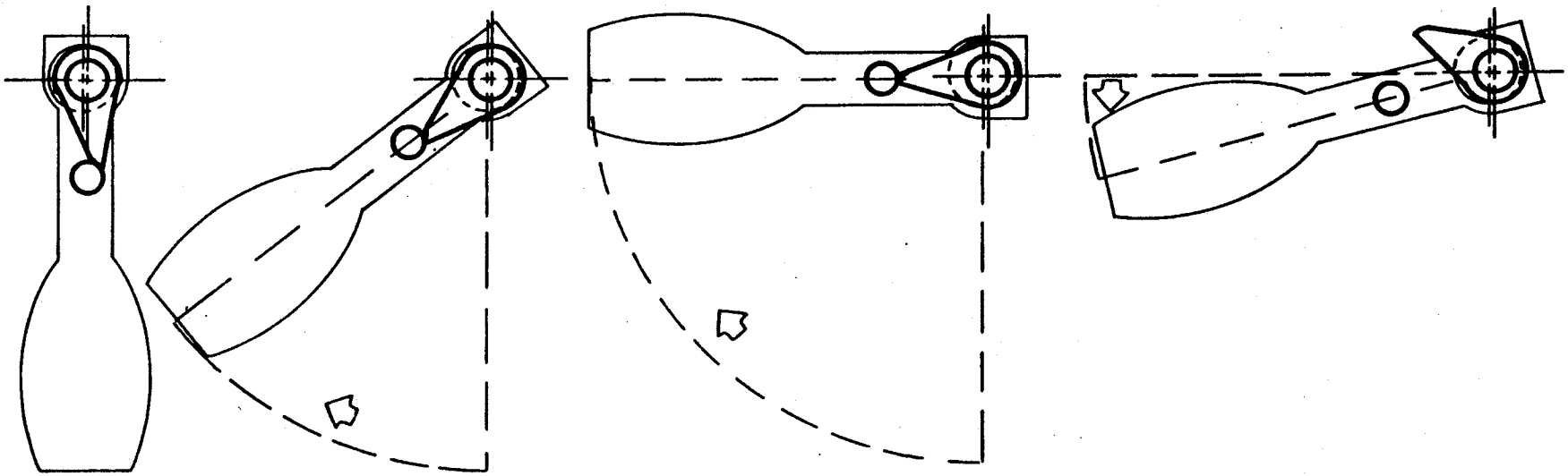
FIG. 7 is a graphical representation of four moving positions of a hammer.
Figure 8:
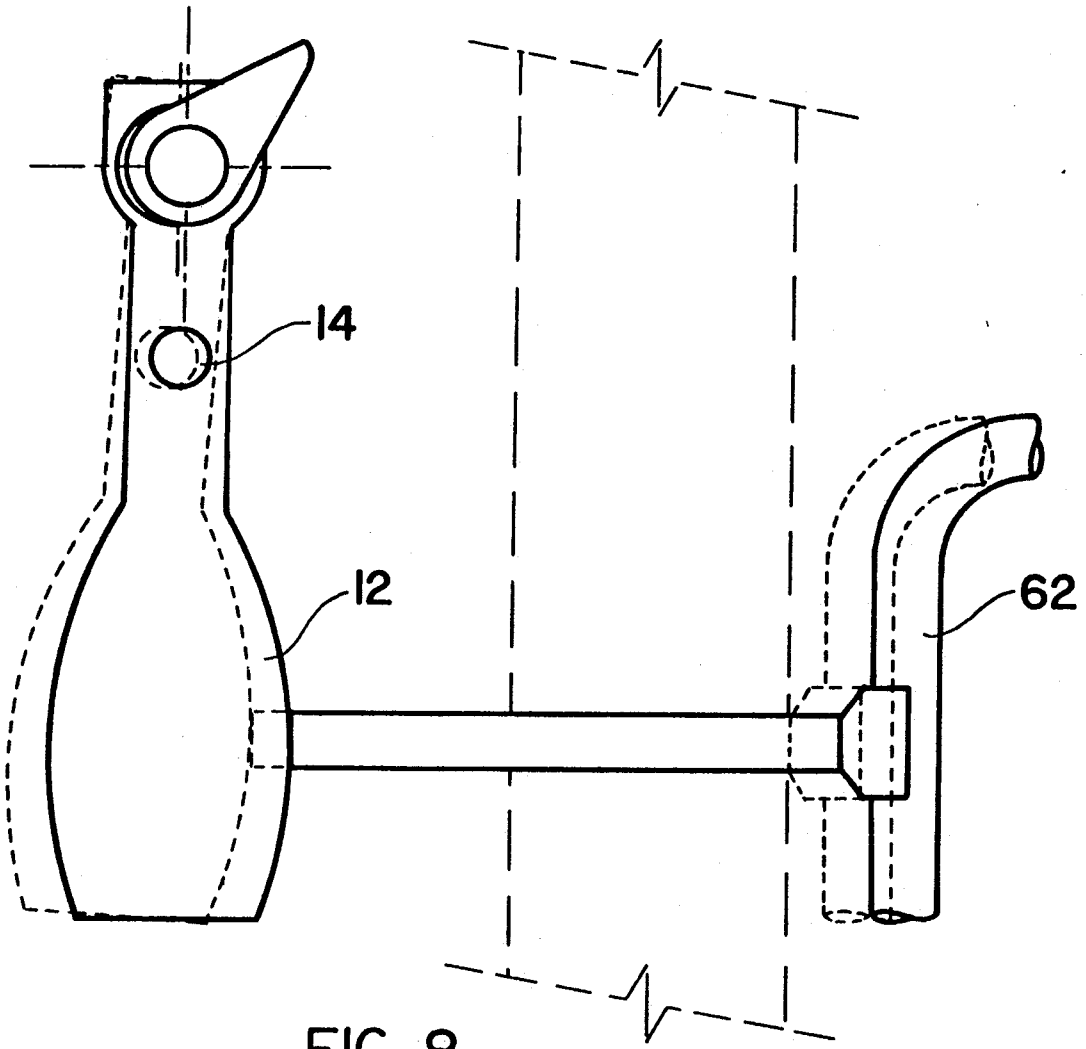
FIG. 8 is a graphical representation of a variation of hitting position.
Figure 9:
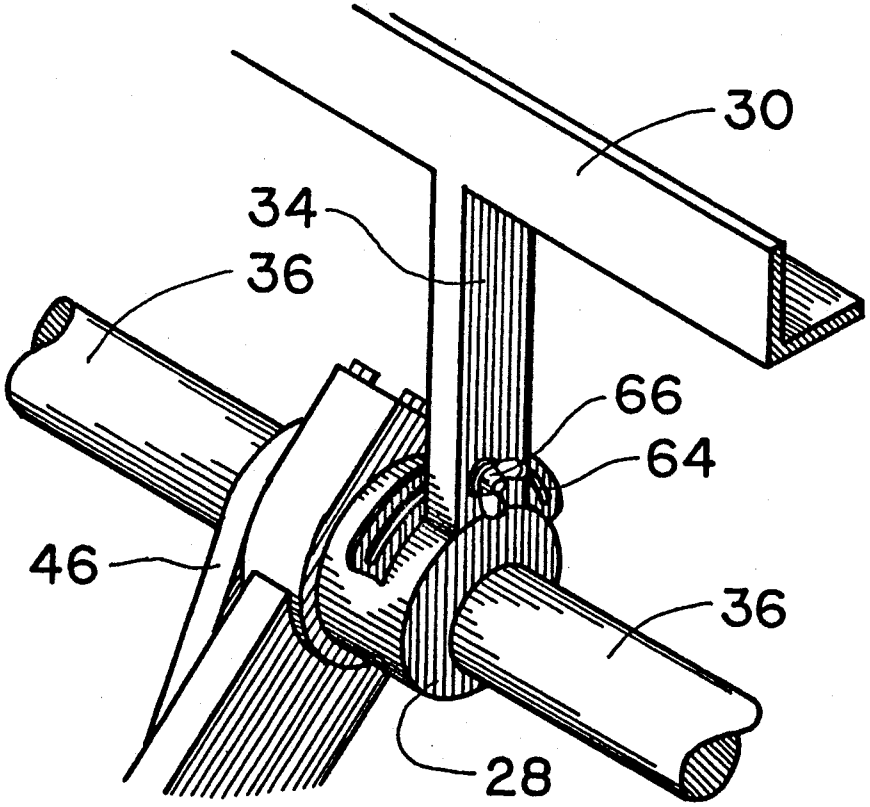
FIG. 9 is a face view of an alternate hammer.

Face 56 . . . FIG. 3 . . . of hammer head 12 comes into contact with center 58 of the face of the rod 52 at the moment of impact. A particle of the head located on the face 56 of hammer 10 tracers a circle of which the radius starts at the center of the eccentric; a particle located at the face 58 is subjected to a linear displacement . . . FIG. 8 . . . towards the right in as much as rod 52 is displaced towards the right as a result of thermal expansion of rod 52 and tubes 62. A curve may be traced with points similar to 56 on head 12, curve which is part of a tangent parallel to face 58 of the rod, and that curve is valid over a distance extending from an angle of −2° with respect to the vertical up to about 10°, that is implying a displacement of rod 52 of about one (1) inch towards the right for a total distance of swing of a hammer of about ten (10) inches. The higher part 60 of head 12 near support does not come into contact with rod 52 as long as eccentric 18 is localized in such position that head 12 suspended vertically only begins to offer its face 56 to and against face 58 of rod 52: at that moment the high part 60 of the face of the hammer may take the same shape 62 . . . FIG. 9 . . . as the shape starting downwards from position 56, the reason being to allow a greater weight to hammer head 12, thanks to the supplemental zone 64.

A device such that a hammer 10 with a hammer head 12 of calculated shape permitting such head to hit a hammering rod 52, which is not always positioned . . . FIG. 8 . . . at the same position, provided the impact of the hammer be made in the axis of the hammer rod 52. Hammer 10 is supported by a sleeve bearing 18 which is eccentric with respect to the axis of motorized shaft 16. On the motorized axis 16 is fixed a cam 46. That cam causes the raising of hammer 10 by engaging hammer support 14. On the hammer one finds a lug 38 provided with a rotating crown 44 which allows for a minimal wear of the tip of cam 46 which would otherwise slide on the surface of crown 44 and would tend to wear.

Other Embodiments

The present system may be further improved by adding to the collar 16 surrounding the eccentric 18 a locking slide 64 with screw 66 to position two hammers a first one 20 relative to the second one 30 a certain distance in time and angle. Furthermore by changing the eccentricity and the angle thereof one can modify the effective momentum of each individual hammer. Modifying the eccentricity means determining precisely the moment and angle at which the hammer is to be released and therefore the momentum transmitted to the hammering rod. One needs only place the center of the eccentric sleeve at 180° of the angle at which one desires to release the hammer.

It is also possible to modulate the successive releasing of a series of hammers such that an assembly of hammers causes a shock wave moving from one end to the other end of a series of coiled tubes.

Other embodiments are possible only limited by the scope of the appended claims.

We claim:

1. A precise hammering device for an array of horizontal rods, each rod having a vertical hitting face, said hammering device comprising:

a horizontal shaft disposed perpendicularly with respect to said array of rods and rotatable around its first axis and driving means causing the rotation of said shaft;

a series of hammers freely mounted on said shaft for the vertical rotation about a second axis which is eccentric relative to the axis of said shaft, said hammers when in rest position taking a vertical position suspended from said shaft and each hammer comprising:

a head with a hitting surface and a support shank;

a lug carried by said shank and installed parallel to the hitting surface;

cam means fixed to the shaft and rotating about the shaft for raising the hammers in a first direction about the axis of the shaft through less than a half turn away from said face of said rod, from said rest position, said cam means releasing said hammers causing their fall in the opposite direction by gravity.

2. A hammering device as defined in claim 1 wherein cam means comprise a cam fixed to the shaft and acting on said lug, said cam engaging said lug eccentrically, causing the release of said hammer when said lug has reached a certain position on said rotating cam.

3. A hammering device as defined in claim 1 wherein said lug is covered by a rotating peripheral face.

4. A device as defined in claim 1 wherein specific sector of use lies between 100 to 130 degrees with respect to the rest position.

5. A device as defined in claim 1 wherein hitting face of said hammer defines a cam such that an apex point coincides with horizontal hitting axis in a set of hammer positions varying between −2° and 8°.

* * * * *